US007079807B1

(12) United States Patent
Daum et al.

(10) Patent No.: US 7,079,807 B1
(45) Date of Patent: Jul. 18, 2006

(54) SUBSTANTIALLY INTEGRATED DIGITAL NETWORK AND BROADCAST RADIO METHOD AND APPARATUS

(76) Inventors: Daniel T. Daum, 5729 TrowBridge Way, San Jose, CA (US) 95138; George E. Scott, III, 7581 Meadow Ct, Dublin, CA (US) 94568

( * ) Notice: Subject to any disclaimer, the term of this patent is extended or adjusted under 35 U.S.C. 154(b) by 911 days.

(21) Appl. No.: 09/457,728

(22) Filed: Dec. 10, 1999

Related U.S. Application Data

(60) Provisional application No. 60/111,790, filed on Dec. 11, 1998.

(51) Int. Cl.
*H04H 7/00* (2006.01)

(52) U.S. Cl. ..... 455/3.06; 455/150.1; 455/152.1

(58) Field of Classification Search ..... 455/150.1, 455/154.1, 158.4, 160.1, 161.2, 166.2, 168.1, 455/176.1, 178.1, 180.1, 183.1, 142, 143, 455/145, 151.1, 193.1, 194.2, 188.1, 188.2; 375/316

See application file for complete search history.

(56) References Cited

U.S. PATENT DOCUMENTS 5,584,051 A * 12/1996 Goken ..... 455/68
6,230,325 B1 * 5/2001 Iinuma et al. ..... 725/110
6,288,748 B1 * 9/2001 Watanabe et al. ..... 348/511
6,310,654 B1 * 10/2001 Oku et al. ..... 348/554
6,314,094 B1 * 11/2001 Boys ..... 370/352
6,317,784 B1 * 11/2001 Mackintosh et al. ..... 709/219

* cited by examiner

*Primary Examiner*—CongVan Tran
(74) *Attorney, Agent, or Firm*—Robert Platt Bell

(57) ABSTRACT

A multimedia system which substantially integrates analog functions normally found in consumer radios (radio frequency tuner functions, volume functions), and information streams from a digital network in a single design. The system may include an Ethernet interface, central processing unit, memory, local storage device, analog to digital converter, digital to analog converter, audio output speakers, microphone, display controller, liquid crystal display panel, user interface logic, controls for tuning streams, analog and digital radio frequency tuner, and an analog storage device. The system may generate analog signals for audible reproduction. The source of audio signals may be configured in real time by the user. The hardware implementation allows for selection of broadcast radio or digital network streams such that hardware signals indicating which broadcast radio or digital stream to play from are fed to a hardware circuit which determines which stream is sent to an audio output device.

10 Claims, 6 Drawing Sheets

SUBSTANTIALLY INTEGRATED DIGITAL NETWORK AND BROADCAST RADIO METHOD AND APPARATUS

CROSS-REFERENCE TO RELATED APPLICATIONS

The present application claims priority from Provisional U.S. Patent Application Ser. No. 60/111,790, filed Dec. 11, 1998 and incorporated herein by reference.

FIELD OF THE INVENTION

This invention relates generally to the field of multimedia play back systems. More particularly, this invention relates to an integration of analog functions found in radios today and the play back of media streams which broadcast over a digital network or information which exists on a digital network. This invention may be particularly suited for any audio stream which may be decoded in real time, in hardware or software. This invention may be even more particularly suited for audio streams which dominate a digital network today, including .MP3 files defined by the ISO/IEC International Standard specification for MPEG layer 3 audio and Real Networks compressed data streaming technology known as RealAudio.

BACKGROUND OF THE INVENTION

Radio stations may broadcast in different analog radio frequency domains. Audio signals may be transmitted through radio frequency (RF) waves, which may come from a transmission tower. If there is no interference, or the tower is not too far from a receiver (or tuner), audio frequencies may be presented to a user via an audio speaker. Audio signals may also be broadcast in a digital fashion. Digitally encoded media packets may be transmitted by radio frequency waves, which may come from a satellite. If there is no interference, packetized data may then be decoded, converted back to analog signals, and may be presented to a user via an audio speaker.

Radio stations may broadcast transmissions over a digital network. General-purpose computers have been adapted to take media streams from a digital network and present them to a user. In prior art embodiments of a digital network audio broadcast, the stream may be compressed on a server, sent to those general-purpose computers which are connected to that server on a digital network, data may be sent to a user general-purpose computer, uncompressed, converted into analog information, and may be presented to an audio speaker.

Downloading media streams to a general-purpose computer may be accomplished by connecting to a particular digital network address. Different media streams may come from different address on a digital network. In order to obtain information from a digital network, a general-purpose computer may communicate with digital network servers to connect properly to a specific digital network site.

FIG. 1 illustrates a Prior Art analog circuit ("radio") which may be employed in typical radio frequency broadcast. Antenna 101 may receive radio waves from the air, and depending where tuner 106 is physically located, a particular frequency may be decoded and sent to amplifier 111 such that the information presently broadcast at that frequency may be audible over speaker 110. The frequency decoded by the position of the tuning mechanism may be user selectable by controllable knobs 102.

User interface logic 103 may then configure tuner 106. User interface logic 103 may be physically represented by a system of pulleys, gears, or other mechanical means, or by a digital tuner interface. User interface logic 103 may control analog storage 112 to record or play back broadcast radio audio streams. User interface logic 103 may control alarm 105 to notify the user when a specific time has been reached. Notification may be in the form of a fixed frequency audible tone, or enabling the output of tuner 106. User interface logic 103 may interact with time keeper 113 such that functions such as alarm 105 may be triggered at the correct user configurable time.

FIG. 2 illustrates a block diagram of a Prior Art general-purpose computer hardware. Circuits which represent mouse and keyboard interface logic and hardware 210, central processing unit 215, system memory 214, bus arbitration and memory arbitration logic 213, display controllers 208, display devices 207, and audio decoders 202 with speakers 206 are considered prior art and typical of computer designs.

The purpose of the hardware of the general-purpose computer of FIG. 2 in terms of audio play back may be enhanced by the addition of digital network interface card 200, which may be used to present media streams from a digital network. Central Processing Unit (CPU) 215 may be used to decode data received over system bus 216 from digital network interface card 200. Uncompressed digital representations of data may be sent to CRT/LCD controller 208 for presentation to the user on display device 207. Uncompressed digital representations of audio data may be sent by CPU 215 over system bus 216 to audio DAC/ADC 202 for presentation to the user on speaker 206.

The function of the general-purpose computer of FIG. 2 in terms of audio play back may be enhanced by the addition of specialized analog radio frequency tuner and decoder 201. Control software may communicate over system bus 216 to digitally 5 manipulate and tune a specialized analog radio frequency tuner and decoder 201. Analog audio input may be encoded by audio DAC/ADC 202 once received from microphone/input 217.

CPU 215 may also incorporate a method of keeping time. Synchronization of this method may be done by querying a time server connected to the digital network interface card 200. The time keeping method may also incorporate time events. These events may start play back of either a user selected digital information stream, locally stored information stream, broadcast radio, or locally stored analog media. The events may also trigger storage of user selected digital streams either simultaneously or sequentially, and/or broadcast radio.

FIG. 3 illustrates a block diagram of how software may execute on a general-purpose computer configured with digital network interface card 200 and specialized analog radio frequency tuner and decoder 201. FIG. 3 illustrates how a general-purpose computer may interact with a network and generalized server computer which provides media streams over a network, and how data may be sent from a general-purpose computer to be broadcast over a digital network. Control software 301 through 309 control various stages of how a user may enter keystrokes or click a mouse to enable a particular piece of a general-purpose computer to play analog and digital media streams.

The General-purpose computer described in FIG. 3 may also decode digitally encoded media packets which may be transmitted by radio frequency waves. In order to configure the system to play back this digital radio media stream, functional blocks may have a dual purpose. Radio frequency broadcast to analog transducer software control 307 may enable specialized radio frequency tuner and decoder 201 previous described in FIG. 2 to also decode media packets before sending it to audio DAC/ADC 202 for presentation to the user.

Broadcast radios described in FIG. 1 may not be connected to a digital network and may not have the capability to play back digital media streams from a digital network. Broadcast radio receivers may not have the capability of digitally broadcasting media streams over a digital network. Broadcast radio receivers may have the capability to record analog media to a storage device, such as a cassette tape. Broadcast radios receivers may not have the capability to record digital media from a digital network. This may render a broadcast radio receiver useless for gathering information from a digital network or sending it to a digital network.

General-purpose computers may play back digital media streams from a network or connection to a digital network. General-purpose computers may play back analog radio frequency signals much like an analog radio with a specialized computer card which digitally tunes frequencies. General-purpose computers may also decode digitally encoded media packets which may be transmitted by radio frequency waves. General-purpose computers may have media stream inputs which may be encoded and broadcast over a digital network.

General-purpose computers may have the ability to record media streams from a digital network or a radio frequency source. General-purpose computers may require a general-purpose user interface such as keyboard or mouse which may be used to configure analog radios with digital interfaces and digital network addresses for digital network media streams. General-purpose computers may be configured through a variety of software functions which may rely upon general-purpose user interfaces such as a keyboard or a mouse. General-purpose computers may have any one of these functions added by different manufacturers. Configuration and use may take multiple windows and user interactions to create the desired effect. General-purpose computers may not have an integrated control mechanism which may be manipulated for broadcast radio frequencies, digital network address tuning, volume control, recording enable, digital network broadcast enable, time event selection, secure transaction selection, user preference enable, and stream purchase/rental selection.

SUMMARY OF THE INVENTION

The present invention includes an apparatus for controlling the play back of radio frequency broadcast as well as controlling the play back of digital media streams from a digital network. These functions may be substantially integrated into a single design circuit as described in a general-purpose computer, but has the scale and design of a small appliance, such as a radio, or a consumer electronics stereo receiver and tuner. The device is configured for digital and analog broadcast streams not in the fashion which general-purpose computers have, but in a similar manner as the described analog radio in FIG. 1.

A first embodiment of the present invention comprises a hardware circuit which may tune broadcast radio frequency broadcasts and media streams broadcast over a digital network at different addresses. The tuning mechanism of the present invention may be embodied by, but not limited to, a tuning knob or a series of buttons which when pushed, select digital network addressing selections and disable analog radio frequency tuning. The tuning mechanism of the present invention may be embodied, but not limited to, a small network appliance such as a clock radio. It may also be embodied by and integrated stereo system tuner device or receiver commonly found in consumer stereo equipment.

A second embodiment of the present invention comprises a hardware circuit to select either radio frequencies (which may be analog amplitudes or digital packets of media information) or digital network addresses for media stream play back. Such a hardware circuit may be used in conjunction with the first embodiment of the present invention and may be thought of as a tuning selector.

A third embodiment of the present invention comprises a hardware circuit which substantially integrates recording, storing, and playing back either a broadcast radio frequency (which may be analog amplitudes or digital packets of media information) or digital media stream broadcast over a digital network. Such an embodiment may be used in conjunction with the first and second embodiments of the present invention and may be thought of as a recording selector.

A fourth embodiment of the present invention comprises a hardware circuit (in conjunction with a substantially integrated circuit described in the first, second, and third embodiments of present invention) to record analog input signals and broadcast such signals over a digital network.

A fifth embodiment of the present invention comprises a hardware circuit (in conjunction with a substantially integrated circuit described in the first, second, third, and fourth embodiments of present invention) to record or play back at selected times a selection of analog or digital streams.

A sixth embodiment of the present invention tunes broadcast radio frequencies while tuning multiple digital streams with different digital network addresses at the same time. This sixth embodiment allows simultaneous broadcast radio frequencies and digital information to be presented to the user.

A seventh embodiment of the present invention comprises a substantially integrated system comprised of a radio and a general-purpose computer. The substantially integrated system of the seventh embodiment has all of the functions of a general-purpose computer except that it does not have a general-purpose computer interface. The interface of the seventh embodiment of the present invention emulates an analog radio (which may be able to decode media packets of information broadcast on analog radio, also known as digital radio) with a display and tuning circuits similar to that found on radios, but extended to include digital network address selection as a means for different media streams to be played.

An eighth embodiment of the present invention enables software on the substantially integrated appliance, software running on a server in the network, and software running on a network access device to work in conjunction with each other for network appliance configuration purposes. This eighth embodiment enables the use of identifier keys on the appliance to determine which configuration stored on a network server is associated with a substantially integrated appliance.

A ninth embodiment of the present invention enables software on a network access device to retrieve playlists from one configuration space, and an associated appliance, and inject that playlist onto the configuration of another device. This ninth embodiment allows users of to take lists of streaming media locations on the network and share them with other integrated appliances.

A tenth embodiment of the present invention enables software running on an integrated appliance to retrieve information from a network server which provides extra information on the digital and analog media rendered by the integrated appliance. This tenth embodiment provides a user extra information about the media stream obtained from a digital network or an analog receiver. Extra information may include station type or class of media being played, which artist has generated the media content, the name of the content, and/or data to help a user decide how to purchase items related to the media streams on a digital network.

An eleventh embodiment of the present invention enables software running on an integrated appliance to retrieve information from a network server which provides extra graphical information relating to the selected media stream. Analog and digital streams may both have graphical information. Graphical information may include icons to help a user distinguish what media streams may be selected.

A twelfth embodiment of the present invention enables software running on an integrated appliance to retrieve information from a network server to determine the look and feel of all information presented to a user. This twelfth embodiment allows the user to select which "skin" the integrated appliance has. Skins may be thought of a series of bitmaps, fonts, and user presentable objects that all share a common theme.

A thirteenth embodiment of the present invention enables application software running on a configuration server to understand where in the digital network packets are coming from. This allows application software running on a configuration sever to decipher what time zone the appliance is physically located. This gives the configuration management system the ability to set the current time and time zone of the integrated appliance.

DETAILED DESCRIPTION OF THE INVENTION

Figure 1:
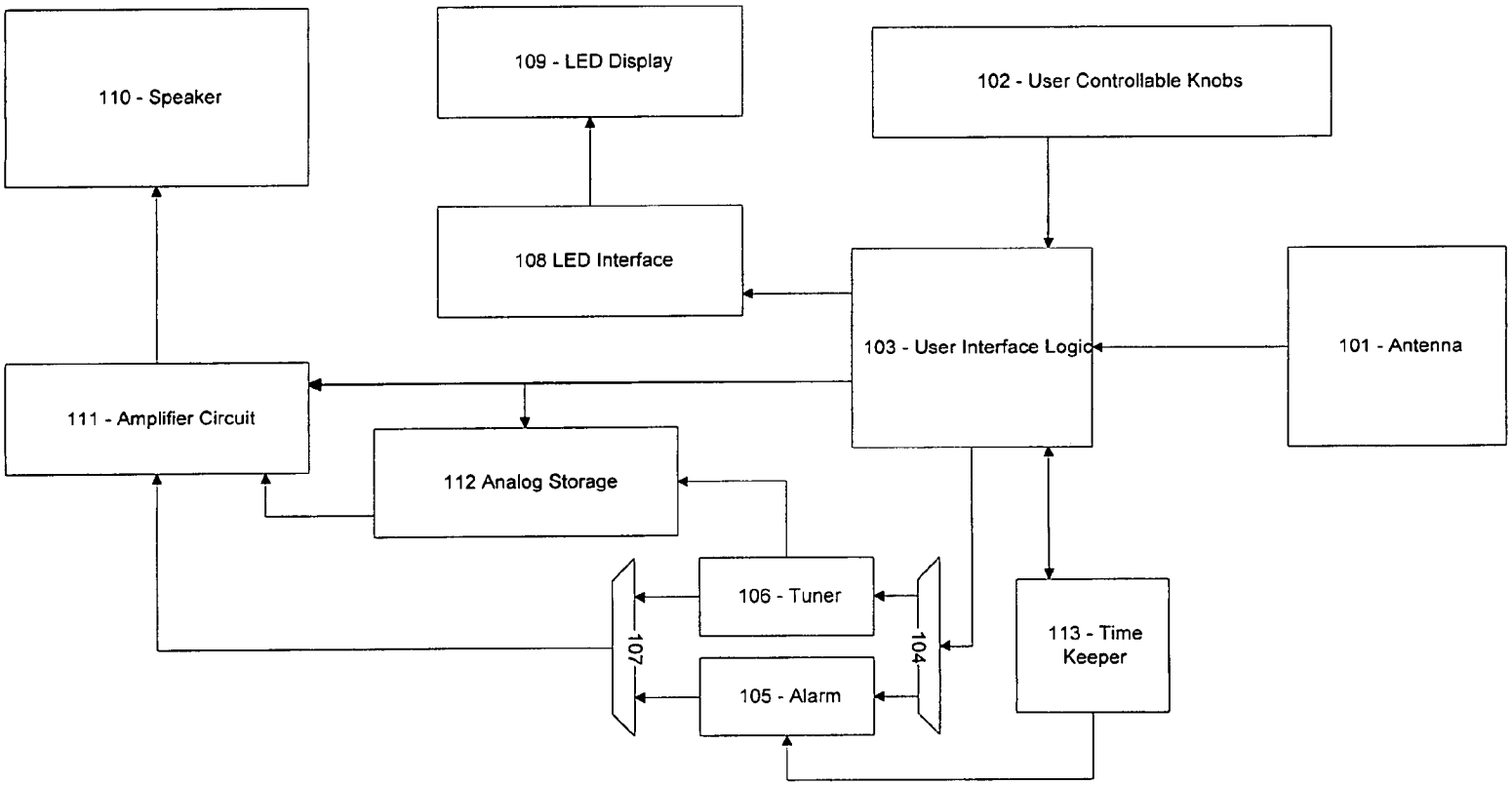
Figure 1 (Prior Art)
FIG. 1 is a block diagram illustrating a prior art embodiment of an analog alarm clock or clock radio hardware circuit.

In prior art FIG. 1, radio signals from an analog transmission source may be received from broadcast through the air by the antennae 101. The signal which is deciphered may be selected by user controllable knob 102. As knobs 102 are adjusted for tuning, a system of pulleys may be used to physically adjust tuner 106, thus changing radio stations. User interface logic 103 may interact with user interface knobs 102 to control alarm functions, present time, time setting and may contain other analog functions.

User interface logic 103 may send signals to 104 to enable an alarm 105, or it may send control signals to select the enabling of radio play back tuner 106. Block 107 may send either or both of these signals to an amplifier circuit 111, which in turn may send signals to a speaker 110, enabling a user to hear the tuned station selected by tuner 106.

User interface logic 103 may have a clock and may also have an LED interface 108 so that the present time may be displayed on LED display 109. User interface logic 103 may use the clock to compare with time keeper 113. If internal state information such as when an alarm should go off, and user interface logic 103 gets a signal from time keeper 113, it may switch state to enable a timed alarm event.

Knobs 102 may also attenuate the volume level of the broadcast. User interface logic 103 may interact with knobs 102 to set the attenuation level of amplifier circuit 111. User interface logic 103 may interact with knobs 102 to select the recording of or play back from analog storage device 112.

Figure 2:
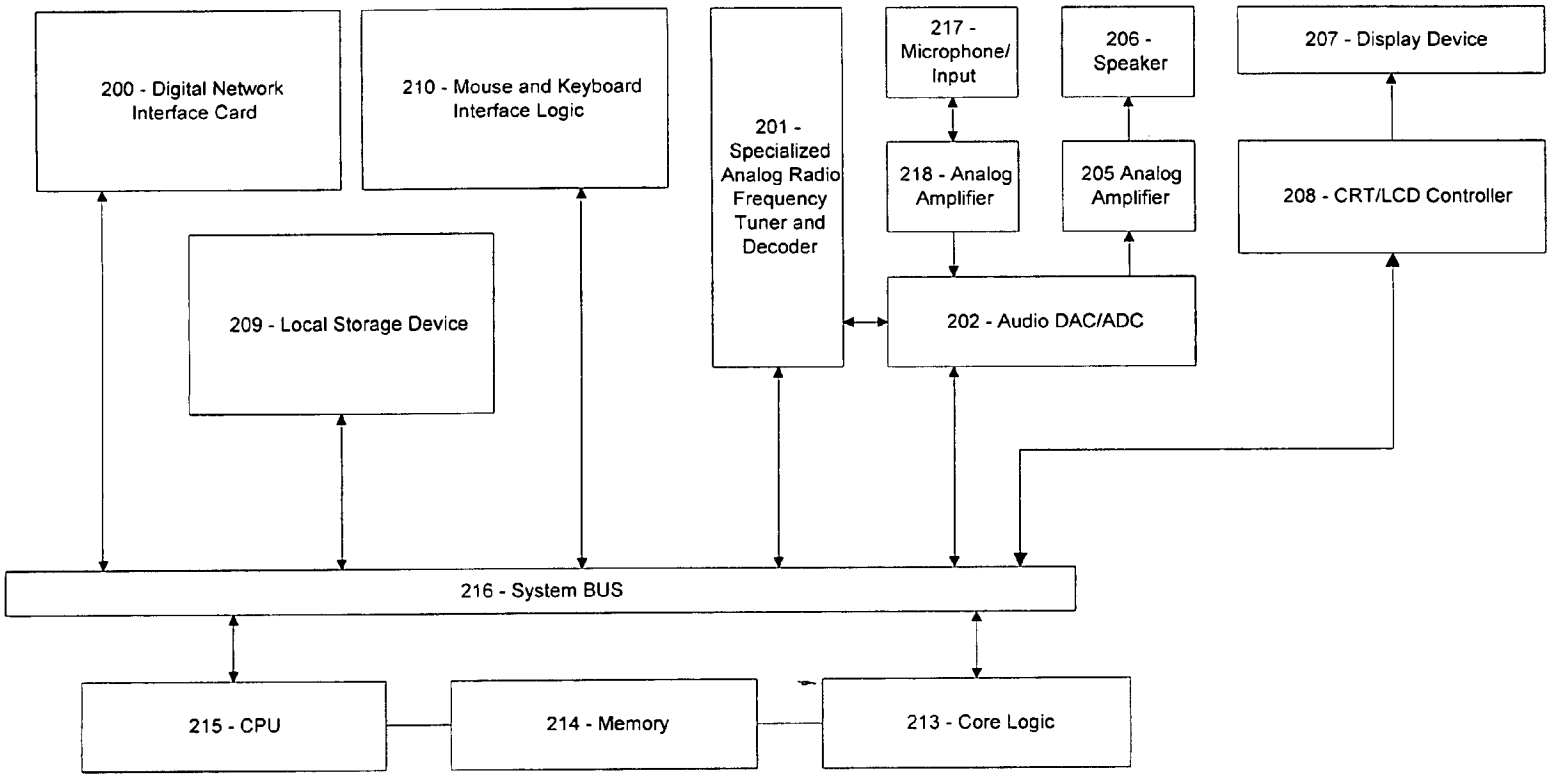
Figure 2 (Prior Art)
FIG. 2 is a block diagram illustrating a prior art embodiment of a general-purpose personal computer hardware circuit.

In prior art FIG. 2, a personal computer CPU 215 may decode information from digital network with digital network interface card 200. As data is streamed over digital network interface card 200, the data may be temporarily stored in memory 214. At the same time all peripherals on system bus 216 may interact with CPU 215 through core logic 213. Software may be controlled through mouse and keyboard interface logic 210.

Data streamed over a digital network may be saved before or after CPU 215 has decoded this information on local storage device 209. Media images may be transferred over system bus 216 and decoded by CRT/LCD controller 208, which presents physical images on display device 207.

As audio data travels over system bus 216 to be decoded by CPU 215, it may be sent back over system bus 216 while core logic 213 arbitrates access to CPU 215 and arbitrates access to memory 214 with peripherals 210, 209, 208, 202, and 200. Decoded audio 5 data may be sent to audio DAC/ADC 202 for presentation to the user. Audio device 202 may convert digital representations of sound to analog amplifier 205, which in turn may send signals to speaker 206 for presentation of sound to a user.

The generalized personal computer of FIG. 2 may also have a specialized analog radio frequency tuner and decoder 201 built onto the same computer card as audio device 202. It may have specialized digital interfaces for software control allowing digital software to control functions, resulting in sending digital data to audio DAC/ADC 202 for presentation of sounds to speaker 206.

Analog audio signals may be input into the system by microphone/input 217. The attenuation of these analog audio signals may be controlled by analog amplifier 218 before being sent to audio DAC/ADC 202. Analog signals may be converted to digital data in audio DAC/ADC 202 and sent to CPU 215 over system bus 216. CPU 215 may encode or compress the digital data and enable the data to be sent over system bus 216 to digital network interface card 200. Such a configuration allows a general-purpose computer, with the appropriate control and encoding software to broadcast an audio media stream over a digital network.

Figure 3:
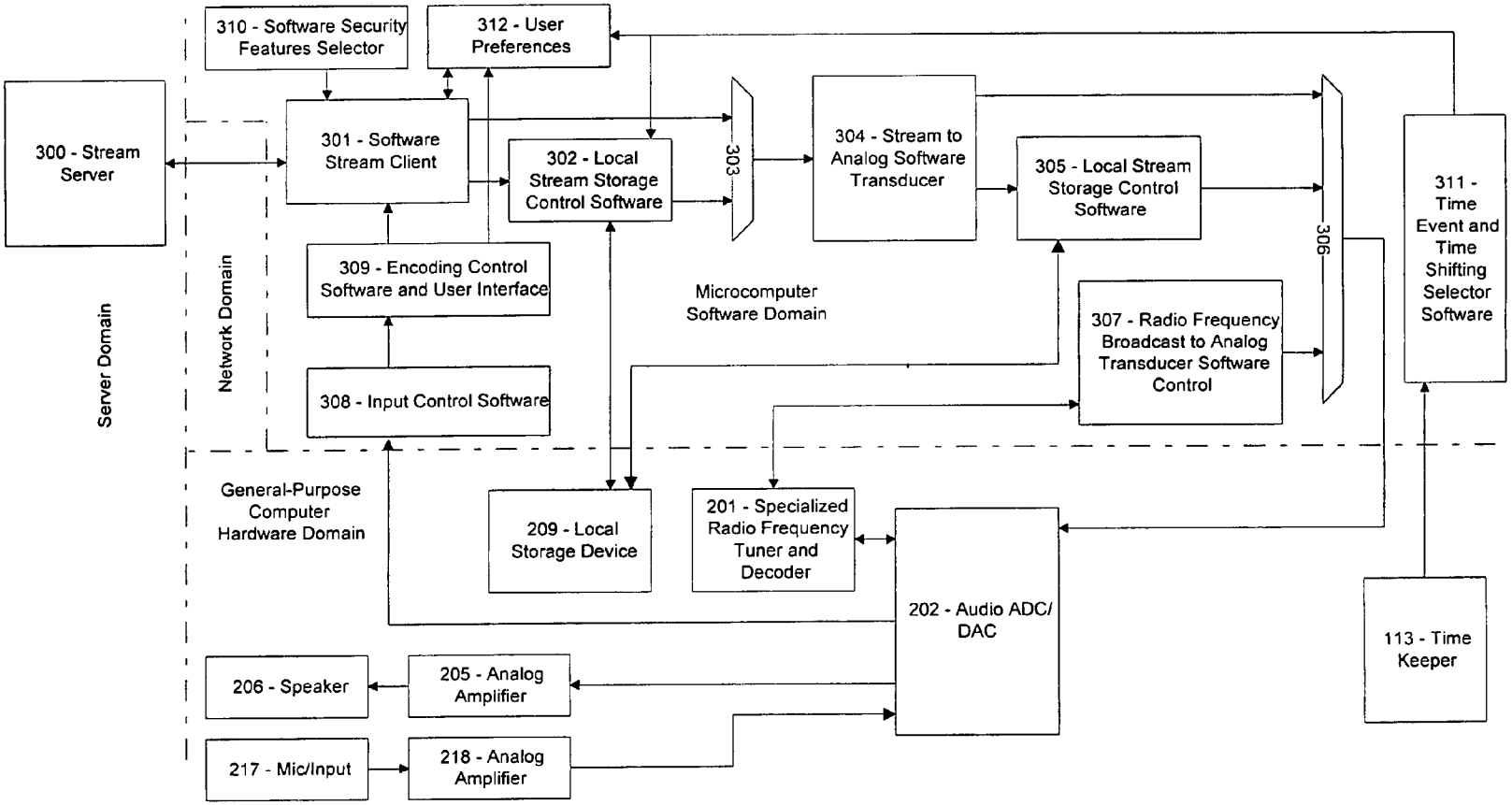
Figure 3 (Prior Art)
FIG. 3 is a block diagram illustrating a prior art block diagram of a personal computer software system which uses a general-purpose personal computer hardware circuit to decode analog and radio frequency audio sources.

In prior art FIG. 3, a collection of system software is described which may run on a personal computer described in FIG. 2, which may be configured to control different functions of the machine. Stream Server 300 may send bit streams over a network. The network may comprise the internet, a home area network, local area network, a wireless network, or the like. Software stream client 301 may decode such a stream and send it to local stream storage control software 302.

Local Stream storage control software 302 may then store media streams information on a local storage device 209 referred to in FIG. 2. The software may then be configured through a stored or live stream selector 303 to determine the source of information which moves the stream to analog software transducer 304. If a local storage device is selected, it may obtain such information from local storage device 209 described in FIG. 2.

As data moves out of stream to analog software transducer 304 it may be stored in local storage device 209. Radio Frequency broadcast to analog transducer software control 307 may control a specialized analog radio frequency tuner and decoder 201 described in FIG. 2. Software Stream Selector 306 may control the source of audio which is sent to audio device 202 described in FIG. 2. These sources may include software stream client 301 from a network, local storage device 209 described in FIG. 2, or a specialized analog radio frequency tuner and decoder 201 described in FIG. 2.

Once signals have been homogeneously transformed to analog signals in audio DAC/ADC 202 described in FIG. 2, signals may be sent to analog amplifier 205 described in FIG. 2, which in turn may send signals to speaker 206 describe in FIG. 2 for presentation of sound to a user. The design may be converted into an integrated digital media broadcast system by input control software 308 disabling output functions of audio DAC/ADC 202 described in FIG. 2 and enabling input functions.

In such a system configuration, microphone/input 217 described in FIG. 2 may send data to analog amplifier 205 described in FIG. 2, which in turn sends data to audio DAC/ADC 202 also described in FIG. 2. Input control software 308 may then transfer data to encoding control software and user interface 309. The data may then be compressed and manipulated for transfer from software stream client 301 over a network domain to stream server 300. At that point, data may be broadcast over a digital network.

Software security features selector 310 may used to ensure that stream play back or stream purchasing is done in such a manner that no one else may either deliver unauthorized streams or appropriate a user identity. Time event and time shifting selector software 311 may determine stream/audio play back, or recording at specific times from time keeper 113 previously described in FIG. 1.

User Preferences software 312 may record user selections to determine user preferences. These preferences may be used to gather desirability of particular streams and may include user selections for time shifting or time based events. The desirability of a particular stream may be of interest to advertisers. Alternatively, user preferences may be used by stream server 300 to automatically determine other streams that may be of interest to the user, and present them. The prior art is described as "cookies" used by Internet (Web) browsers and servers.

Figure 4:
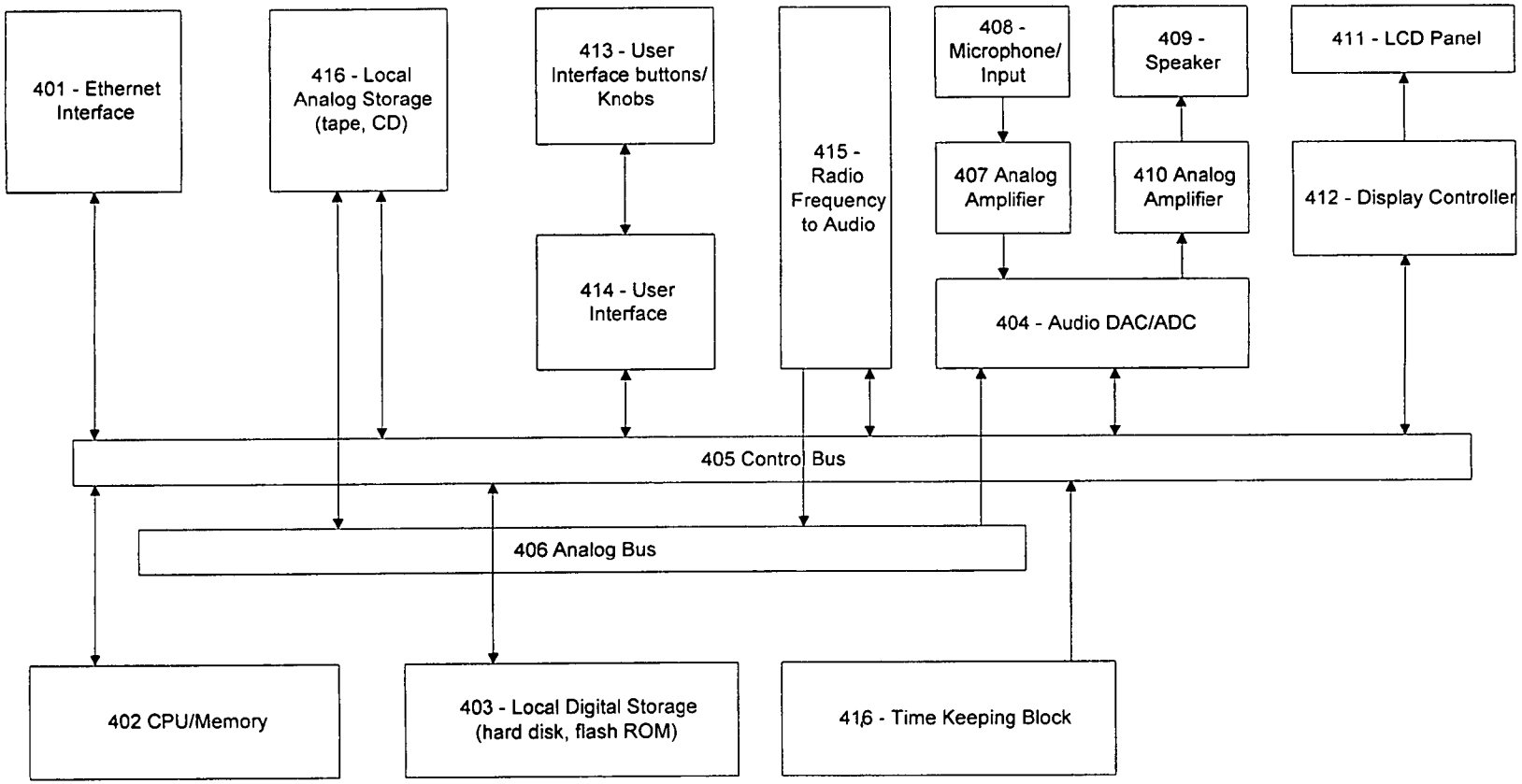
FIG. 4 is a block diagram of an embodiment of the present invention illustrating a Substantially Integrated Digital Network and Broadcast Radio Apparatus.

FIG. 4 is a block diagram of one embodiment of the present invention, illustrating how an integrated design allows digital media streams from a digital network and broadcast radio frequencies to be controlled from the same hardware circuit. The embodiment also details how the same design stores or plays back from storage, broadcast radio frequencies or digital media streams from the previously mentioned hardware control circuit. The embodiment of FIG. 4 also details how the same design may be a digital network broadcasting platform, again from the same integrated hardware control circuit.

To play back streams from a digital network, user interface buttons/knobs 413 may be configured to enable user interface 414 to send the appropriate control signals over control bus 405. These control signals may allow Ethernet interface 401 to interact with a digital network such that digital media streams are being placed onto control bus 405. Data may be transferred from Ethernet interface 401, over control bus 405 to CPU/memory 402.

If the media stream is visual in nature, the data may be uncompressed and transformed such that it may be placed on control bus 405 and readied for presentation to display controller 412. If the media stream is an audio stream, the data will be uncompressed and transformed by CPU/memory 402 such that it is ready for presentation to audio DAC/ADC 404 over control bus 405. Once data is transformed by audio DAC/ADC 404 it is presented to analog amplifier 410 which may control volume of the output signals which are in turn presented to speaker 409.

To play back broadcast radio frequencies from the airwaves, user interface buttons/knobs 413 may be configured to enable user interface 414 to send the appropriate control signals over control bus 405. These control signals may allow data to be sent to analog bus 406 for presentation of data to audio DAC/ADC 404 by radio frequency to audio 415. Radio frequency to audio 415 may contain the ability to decipher digital radio data packets, convert them to analog data and move this data over analog bus 406 for presentation to audio DAC/ADC 404.

Signals may be boosted by analog amplifier 410 before they reach speaker 409 for presentation to the user. Radio frequency to audio 415 may include an antenna to receive analog signals or analog signals containing digital packet information.

To record broadcast radio frequencies, user interface buttons/knobs 413 may be configured to enable user interface 414 to send the appropriate control signals over control bus 405. These control signals may allow broadcast radio frequency signals to be sent from radio frequency to Audio 415 over analog bus 406. In this configuration, data may be sent to local analog storage (tape, CD) 416 which may transfer each signal onto a medium which may be used to play back the same signals at a later time.

To play back a previously recorded analog stream of signals, user interface buttons/knobs 413 may be configured such that data is obtained from a local storage device (tape, CD) 416 and placed onto analog bus 406. Data may then be presented to audio DAC/ADC 404 for presentation to the user over speaker 409.

To record digital media streams, user interface buttons/knobs 413 may be configured to enable user interface 414 to send the appropriate control signals over control bus 405. These control signals may allow Ethernet interface 401 to send data over control bus 405. These control signals may allow CPU/memory 402 to not decompress the data, but to send it back over control bus 405 and store the media stream on local digital storage (hard disk, flash ROM) 403.

To play back a previously recorded digital media streams of data, user interface buttons/knobs 413 may be configured such that data is obtained from a local digital storage device (hard disk, flash ROM) 403 and placed onto control bus 405. Data may then be presented to audio DAC/ADC 404 for presentation to the user over speaker 409.

To broadcast a digital media stream over a digital network, user interface buttons/knobs 413 may be configured to enable user interface 414 to send the appropriate control signals over control bus 405. These control signals may allow analog data to be input into the system by microphone/input 408. The amplitude of these signals may be modified by analog amplifier 407 before being converted to digital data in audio DAC/ADC 404.

The resulting digital data may be placed on control bus 405 such that CPU/memory 402 may modify and compress the data before sending it back over control bus 405 to Ethernet interface 401. Once data has been sent to Ethernet interface 401, the media may be presented to a digital network so that other Substantially Integrated Digital Network and Broadcast Radio Method and Apparatus may decode it and play it back.

To enable play back or recording of radio broadcast frequencies or storage of a digital stream, user interface buttons/knobs 413 may be configured to enable user interface 414 to send appropriate control signals over control bus 405. These control signals may allow time keeping 416 to set up an event which may allow for the recording or play back of a broadcast radio or digital streams. Event setup information may include which source to record or play back, the broadcast radio station to tune to, the digital stream or streams to be recorded or played back, the local stream or streams to play back, the local analog storage location to play from, selection of a fixed frequency sound to play back or which time or times to enable the event.

Time keeping 416 may compare the present time with the stored event times, and when a match is detected, the associated event actions may be enabled. Time keeping 416 may also synchronize with a time server connected to the network, via Ethernet interface 401 to obtain the local time. Alternatively, user interface logic 413 and user interface 414 may used to set the local time.

Figure 5:
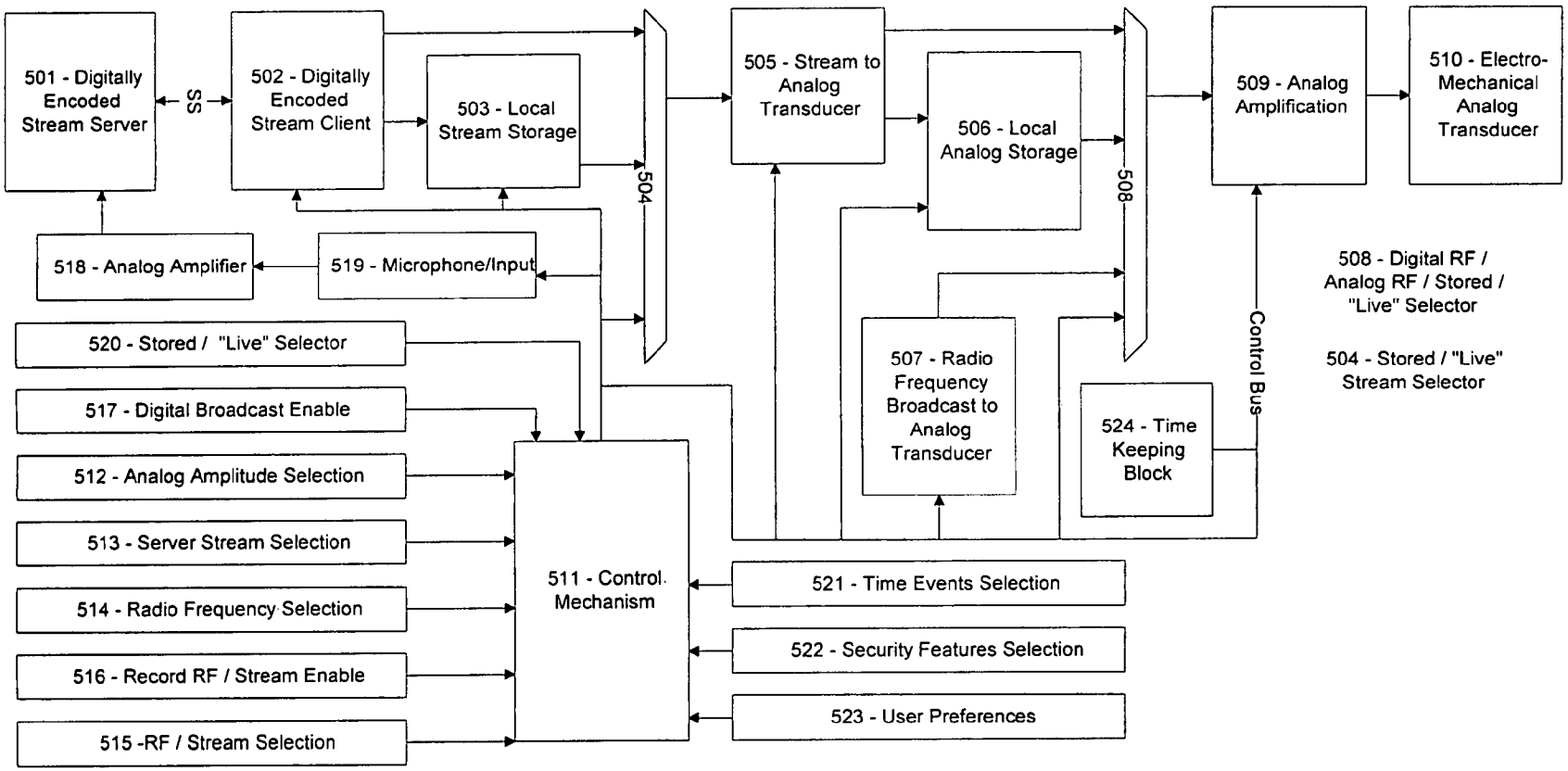
FIG. 5 is a block diagram of another embodiment of the present invention illustrating a Substantially Integrated Digital Network and Broadcast Radio Apparatus.

FIG. 5 is a block diagram of the system described in FIG. 4, illustrating how control may be applied in a substantially integrated design, and specifically how the individual control settings interact with one another in different configurations.

Broadcast Configuration

The system may be configured by control mechanism 511 to broadcast digital streams from digitally encoded stream client 502 to digitally encoded stream server 501 over a digital network. Broadcast enable 517 may be set by the user. This may allow control mechanism 511 to be configured to enable broadcasting. If it is enabled for broadcasting, digitally encoded stream client 502 may become the stream server, and digitally encoded stream server 501 may become both a client and a server to other clients in the digital network. Analog information may be sent from an external device, or from local storage 506, to microphone/input 519. These signals may, in turn, be amplified by analog amplifier 518.

Stored/"Live" selector MUX 504 may be set by the user to select between the output of analog amplifier 518 ("Live") and local stream storage 503 (Stored). The resultant information stream may be then modified by digitally encoded stream client 502. Once data is prepared or compressed, it may be broadcast over a digital network by being sent to digitally encode stream server 501.

When broadcast enable control switch 517 is enabled other switches may or may not be valid or have different meanings. When broadcast enable control switch 517 is enabled, for example, analog amplitude selection 512 may be defined as the input attenuation control for analog amplification 518 and analog amplitude selection 509 may have no meaning. Similarly, when broadcast enable control switch 517 is enabled, server stream selection 513 may be defined as the digital network address to stream the data to and radio frequency selection 514 may have no meaning. In this state, the physical position of RF/stream selection 515 may have no meaning. In addition, when broadcast enable control switch 517 is enabled, record RF/stream enable 516, time events selection 521, and security features 522 may all have no meaning.

Record Configuration

The system may be configured by control mechanism 511 to record digital streams from digitally encoded stream server 501. The system may be configured by control mechanism 511 to record analog or digitally encoded media packet streams from radio frequency broadcast to analog transducer 507. If record RF/stream enable 516 is set by the user to the RF position, the system may record the present station selected by Radio Frequency selection 514. If digital RF/analog RF/stored/"live" selector MUX 508 is placed in the digital RF position, digital packet data which is transmitted over analog radio waves may be decoded and converted to analog signals by radio frequency broadcast to analog transducer 507.

Otherwise, radio frequency broadcast to analog transducer 507 may not decode digital packet information and may tune analog signals directly. Such data may be sent to audio DAC/ADC 404 previously described in FIG. 4 from a built in antenna in radio frequency broadcast to analog transducer 507. The data may then be stored on local analog storage 506. If record RF/stream enable 516 is set by the user to the stream position, the system may record the station selected by server stream selection 513. This data may be compressed by CPU/memory 402 previously described in FIG. 4 and sent to local stream storage 503.

The system may have the capability to record a digital network or broadcast radio stream while decoding and presenting to the user a different stream. The system may have the capability to record a broadcast radio frequency or digital network stream while watching or hearing that stream being presented to the user by the device.

When record RF/stream enable 517 is turned on by the user other switches may or may not be valid or have different meanings. In this state analog amplitude selection 512 may control the attenuation of the present play back stream. The present play back stream may be configured by the setting of server stream selection 513 if RF/stream selection 515 is set to stream. The present play back stream may be configured by the setting of radio frequency selection 514 if RF/stream selection 515 is set to RF. It may be an invalid configuration to have record RF/stream enable 516 in the RF or stream position while Stored/"Live" selector 520 is placed in the stored position. It may be invalid to have broadcast enable 517 to be set to the enable position while record RF/stream enable 516 is enabled by the user. Controls 521, 522, and 523 may be independent controls.

Play Back Configuration

The system may be configured by control mechanism 511 to play back digital streams from digitally encoded stream server 501 or local stream storage 503. Stored/"Live" selector 520 may be configured in the stored position. Digital data may be taken from local stream storage 503, sent to stream to analog transducer 505, sent to analog amplification 509 and presented to Electro-mechanical analog transducer 510 for presentation to the user or display controller 412 previously described in FIG. 4 if the media stream is visual in nature.

Stored/"Live" selector 520 may be configured in the live position. Digital data may come from a particular digital network address selected by server stream selection 513. Data may be decoded by digitally encoded stream client 502 and readied for stream to analog transducer 505 to play back the media stream to electromechanical analog transducer 510 or display controller 412 previously described in FIG. 4 if the media stream is visual in nature.

The system may be configured by control mechanism 511 to play back analog frequencies (or digital media packets that are transported on top of analog frequencies, based on the position of digital RF/analog RF/stored/"live" selector MUX 508) from radio frequency broadcast to analog transducer 507 or local analog storage 506. Stored/"Live" selector 520 may be configured in the stored position.

Analog data may then be taken from local analog storage 506, sent to analog amplification 509 and presented to Electro-mechanical analog transducer 510 for presentation to the user. Stored/"Live" selector 520 may be configured in the live position. Analog data may come from a particular tuned broadcast radio frequency selected by radio frequency selection 514. Data may be readied for analog amplification 509 to play back the analog signals to electromechanical analog transducer 510.

When RF/stream selection 515 is enabled for play back other switches may or may not be valid or have different meanings. For example, when RF/stream selection 515 is enabled for play back, analog amplitude selection 512 may be defined as the output attenuation control for analog amplification 509. In addition, when RF/stream selection 515 is enabled for play back, analog amplitude selection 518, may have no meaning and server stream selection 513 may have no meaning, or be defined as the digital network address to get media streams from.

Similarly, when RF/stream selection 515 is enabled for play back, radio frequency selection 514 may have no meaning, or may select what radio frequency to have the system play back and record RF/stream enable 516 and broadcast enable 517 may have no meaning. In this state, Stored/"Live" selector 520 may determine if a live broadcast radio or digital network stream get used verses a previously recorded broadcast radio or digital network stream. Controls 521, 522, and 523 may be independent controls.

Event Configuration

Time event selector 521 may control time keeping 524 to store multiple event states with associated event times. When time event selector 521 is enabled, other switches may or may not be valid or have different meanings. In this state, switches 520, 512, 517, 513, 514, 516, 515, 522, 523, may not have immediate effect, but may be used to define an event state along with a time selected by time events selection 521. This event state may be stored in time keeping block 524.

When time keeping block 524 detects that the time defined by an event has occurred, the event state may be enabled, and switches 520, 512, 517, 513, 514, 516, 515, 522, 523 may assume the state defined by the event state. For the duration of the time event defined by 521, switches 520, 512, 517, 513, 514, 516, 515, 522, 523 may not accept user input.

Security

Security features selector 522 may allow/disallow control mechanism 511 to store/broadcast streams as described above, or it may allow entry of user identification/security codes/credit card/electronic cash equivalents. Such information may allow the user to purchase/rent/use information streams broadcast by vendors. The information streams may be broadcast in a secure fashion, which may prevent unauthorized use of the stream.

Control mechanism 511, with the security information entered previously, may decode/decrypt the information stream, when receiving said stream. Alternatively, when broadcasting an information stream, control mechanism 511 may encode/encrypt the information stream, utilizing the previously entered security information.

User Preferences

User preferences selector 523 may allow/disallow control mechanism 511 to automatically select information streams/broadcast radio stations, based on user defined criteria not limited to musical type, news source, time of day, geographical location, other user recommendations, or cost. This stream type preference information may be transmitted to information servers for purposes not limited to gathering access statistics, advertising, billing.

Further user preference information may allow/disallow transmittal of the stream type preference information. Further user preference information may control other aspects of the control mechanism 511, not limited to display brightness, and updating of control mechanism 511 programming (if any).

User preferences 523 may use digitally encoded stream client 502 to communicate over the digital network to a specialized network address to determine what digital media streams are to be selectable by the previously described tuning methodology. Once this configuration is completed, control mechanism 511 may interact with display controller 412 previously described in FIG. 4 to select different digital stations.

User preference selection may be embodied, but not limited to, a series of user buttons on the network appliance. In addition, user preference selection may be embodied, but not limited to, a series of icons on LCD panel 411 previously described in FIG. 4. User preference selection may also be embodied, but not limited to, a rolling set of digital network addresses viewable on LCD panel 411 previously described in FIG. 4.

Figure 6:
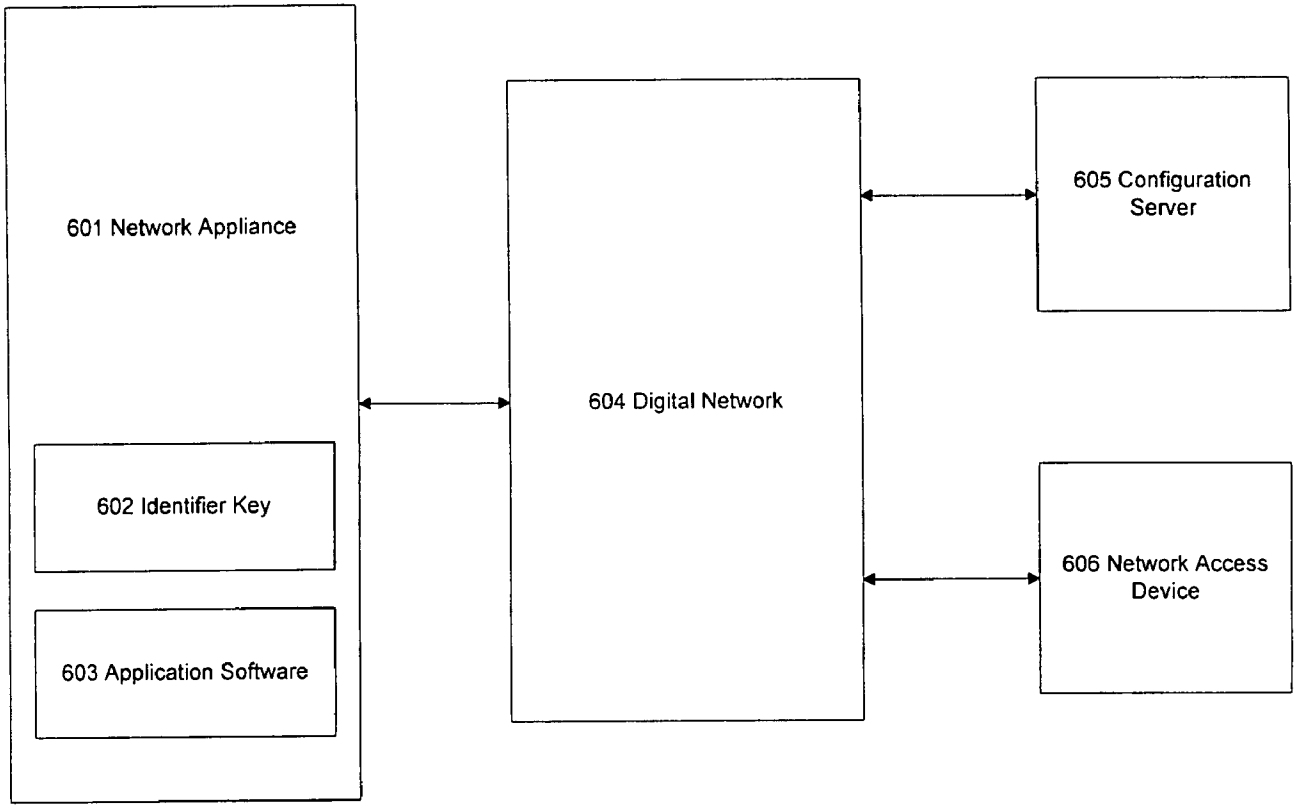
FIG. 6 is a block diagram of yet another embodiment of the present invention illustrating a Substantially Integrated Digital Network and Broadcast Radio Method.

FIG. 6 is a block diagram illustrating how an appliance using the integrated tuner described in FIGS. 4 and 5 may be configured using other components of a digital network. Specifically, FIG. 6 illustrates how the appliance, a network server storing all configuration information, and an application running on a network access device use the digital network to manipulate the appliance from any node in the network. FIG. 6 may be further described as networked configuration management methodology.

To allow network appliance 601 to be configured through digital network 604, a user may employ network access device 606 which in turn may obtain information from configuration server 605. Application software residing on network access device 606 may use standardized software protocols. In this fashion, software running on network access device 606 may not need specific understanding of configuration software found on configuration server 605, allowing a user to view software applications that exist on configuration server 605 without any special modifications from network access device 606.

Network access device 606 may change and modify the configuration of network appliance 601 and save it back to configuration server 605, allowing a user to modify the configuration of network appliance from any generic network access device connected to digital network 604.

Network appliance 601 may also retrieve configuration information. Specifically, application software 603 may use digital network 604 to communicate to configuration server 605. More specifically, application software 603 may use identifier key 602 to get a particular configuration from configuration server 605.

Network appliance 601 may display the current time to a user. Networked configuration management may be employed to retrieve the current time from configuration server 605 when network appliance 601 is first turned on. This may relieve a user of network appliance 601 from having to set the current time.

Application software running on configuration server 605 may look at packets of information coming into it and figure out what network address of digital network 604 is making requests. Application software running on configuration server 605 may be able to decipher what time zone is associated with that network address such that a user need not indicate what time zone they are in. This may further relieve a user from having to decipher what the current time is.

Network appliance 601 may display different media streams to a user. Application software 603 may use digital network 604 to retrieve those media streams and what media streams it should pick as there may be more choices than the network appliance is rendering for a user.

Application software 603 may use digital network 604 to retrieve network addresses of pre-selected media streaming sources. This configuration information may be stored on configuration server 605, allowing network appliance 601 to retrieve media streams from other network servers which may be connected to digital network 604. Network addresses of pre-selected media may be associated with knobs and buttons described in FIG. 4.

Application software running on configuration server 605 may figure out what the network addresses for which streaming media on network appliance 601 is "most listened to". Based on those usage patterns, configuration server 605 may store lists of network addresses which mimic similar streaming media content. Network appliance 601 may be placed into a mode where it allows the network configuration management system to suggest and render digital media streams. Network appliance 601 may do the same for analog broadcasts.

Application software 603 may have the ability to allow a user to indicate a particular media stream should be saved to a list. This list may be stored on configuration server 605, allowing a user to save a list of network locations of streaming media. This may also allow a user to save a list of analog broadcasts.

Application software running on configuration server 605 may allow the sharing of lists. Lists may be generated by a user of network appliance 601 or the networked configuration management system. Network access device 606 may be used to take a list associated with one particular network appliance 601 identified by identifier key 602 and insert it into a list of another network appliance 601 connected to digital network 604 that has a different identifier key 602. Sharing of lists may be accomplished by updating the lists of target network appliances 601 within configuration server 605.

The networked configuration management system may be used to select how data is presented to a user on networked appliance 601. Configuration server 605 may contain different themes of how data is to be displayed on network appliance 601. The network configuration management system may allow any network access device 606 to determine what theme should be displayed. Theme data may include what type of font is used to display information. Theme display may include what kind of background is used when displaying information and/or the layout of the user interface for all data to be displayed.

The networked configuration management system may be used to select how data is presented to a user on networked appliance 601. Configuration server 605 may contain different icons associated with network addresses that stream data which may be saved to a list within the user appliance. Configuration server 605 may contain different icons associated with analog broadcast addresses, allowing network appliance 601 to better help a user to distinguish what analog or digital media stream to choose. The icon may give specific logo information of different media content locations in the analog and digital spectrum.

Application software 603 may use identifier key 602 and the networked configuration management system to retrieve data from configuration server 605 to indicate to the user more information about the media content that is being rendered. Media content information may include what type or classification the media being rendered belongs to. Media content information may include what artist is responsible for creating the content. Media content information may include what the name of the content is. Media content information may include other information helpful to a user. The networked configuration management system may enable a user to make purchases of content based on media content information that may be displayed to the user.

While the preferred embodiment and various alternative embodiments of the invention have been disclosed and described in detail herein, it may be apparent to those skilled in the art that various changes in form and detail may be made therein without departing from the spirit and scope thereof.

We claim:

1. A combined receiver for receiving tuning broadcast radio frequency signals and media streams broadcast over the Internet, the combined receiver comprising:

an Internet interface for interfacing with the Internet to receive from the Internet, a broadcast stream of media content;

an audio decoder, coupled to the Internet interface, for receiving and decoding the broadcast stream of media content to produce a decoded audio stream;

an audio digital to analog converter, coupled to the audio decoder, for receiving the decoded audio stream and outputting a first analog audio signal;

a radio frequency tuner for tuning and receiving broadcast radio frequency signals and outputting a second analog audio signal;

an amplifier, coupled to the audio digital to analog converter, and the radio frequency tuner, for receiving the first and second analog audio signals from the audio digital to analog converter and the radio frequency tuner, respectively, and outputting an amplified audio signal; and at least one speaker, coupled to the amplifier, for generating sound from the amplified audio signal.

2. The combined receiver of claim 1, further comprising:

a user interface, for receiving user inputs to select an audio output, the user interface including means for selecting a radio station from a display of broadcast and Internet radio stations; and a microprocessor controller, coupled to said user interface, said Internet interface, said audio digital to analog converter, and said radio frequency tuner, for selectively switching the first analog output signal from the audio digital to analog converter and the second analog output signal from the radio frequency tuner to the amplifier in response to a user input.

3. The combined receiver of claim 2 wherein said user interface further comprises:

a plurality of tuning inputs, each of which, when activated, enable the microprocessor controller to control the Internet interface to select a corresponding broadcast media stream.

4. The combined receiver of claim 3 wherein said user interface further comprises:

a band selector for tuning the radio frequency tuner to a selected radio band and for tuning the Internet interface to a selected stream of broadcast stream of media content.

5. The combined receiver of claim 2, further comprising:

local media storage, coupled to the microprocessor controller, for storing broadcast media streams and analog audio signals.

6. The combined receiver of claim 2, further comprising:

a display subsystem, coupled to the microprocessor, for displaying information for each tuned band.

7. The combined receiver of claim 6 where the information displayed comprises available analog radio frequency spectrum and which band in that spectrum is selected if the band switch enables that band, the same display subsystem displaying selectable broadcast media streams from the Internet and which location in a set of broadcast media streams is selected if the band switch enables a network broadcast media stream.

8. The combined receiver of claim 2, further comprising:

storage means, for storing at least one of the first analog audio signal, the second analog audio signal and the broadcast media stream;

wherein said user interface may receive signals so as to select at least one of a first analog audio signal, the second analog audio signal, and the broadcast media stream for playback in the combined receiver.

9. A combined receiver for receiving tuning broadcast radio frequency signals and media streams broadcast over a digital network, the combined receiver comprising:

a digital network interface for interfacing with a digital network to receive from the digital network, a broadcast stream of media content;

an audio decoder, coupled to the digital network interface, for receiving and decoding the broadcast stream of media content to produce a decoded audio stream;

an audio digital to analog converter, coupled to the audio decoder, for receiving the decoded audio stream and outputting a first analog audio signal;

a radio frequency tuner for tuning and receiving broadcast radio frequency signals and outputting a second analog audio signal;

an amplifier, coupled to the audio digital to analog converter, and the radio frequency tuner, for receiving the first and second analog audio signals from the audio digital to analog converter and the radio frequency tuner, respectively, and outputting an amplified audio signal;

at least one speaker, coupled to the amplifier, for generating sound from the amplified audio signal;

a user interface, for receiving user inputs to select an audio output;

a microprocessor controller, coupled to said user interface, said digital network interface, said audio digital to analog converter, and said radio frequency tuner, for selectively switching the first analog output signal from the audio digital to analog converter and the second analog output signal from the radio frequency tuner to the amplifier in response to a user input; and a display subsystem, coupled to the microprocessor, for displaying information for each tuned band, wherein the information displayed comprises available analog radio frequency spectrum and which band in that spectrum is selected if the band switch enables that band, the same display subsystem displaying selectable broadcast media streams and which location in a set of broadcast media streams is selected if the band switch enables a network broadcast media stream, and wherein multiple broadcast media streams are being tuned and streamed at the same time so as to alleviate pauses in the broadcast media stream over the digital network when new addresses are selected, resulting in a new media stream to be tuned substantially faster over the digital network.

10. A combined receiver for receiving tuning broadcast radio frequency signals and media streams broadcast over a digital network, the combined receiver comprising:

a digital network interface for interfacing with a digital network to receive from the digital network, a broadcast stream of media content;

an audio decoder, coupled to the digital network interface, for receiving and decoding the broadcast stream of media content to produce a decoded audio stream;

an audio digital to analog converter, coupled to the audio decoder, for receiving the decoded audio stream and outputting a first analog audio signal;

a radio frequency tuner for tuning and receiving broadcast radio frequency signals and outputting a second analog audio signal;

an amplifier, coupled to the audio digital to analog converter, and the radio frequency tuner, for receiving the first and second analog audio signals from the audio digital to analog converter and the radio frequency tuner, respectively, and outputting an amplified audio signal;

at least one speaker, coupled to the amplifier, for generating sound from the amplified audio signal;

wherein multiple broadcast media streams are being tuned and streamed at the same time so as to alleviate pauses in the broadcast media stream over the digital network when new addresses are selected, resulting in a new media stream to be tuned substantially faster over the digital network.

* * * * *